US006203667B1

(12) United States Patent
Huhtelin

(10) Patent No.: US 6,203,667 B1
(45) Date of Patent: Mar. 20, 2001

(54) METHOD FOR REGULATING BASIS WEIGHT OF PAPER OR BOARD IN A PAPER OR BOARD MACHINE

(75) Inventor: Taisto Huhtelin, Tampere (FI)

(73) Assignee: Neles Paper Automation Oy (FI)

( * ) Notice: Subject to any disclaimer, the term of this patent is extended or adjusted under 35 U.S.C. 154(b) by 0 days.

(21) Appl. No.: 09/329,768

(22) Filed: Jun. 10, 1999

(30) Foreign Application Priority Data

Jun. 10, 1998 (FI) ..... 981329

(51) Int. Cl.[7] ..... D21F 1/06; D21F 1/08

(52) U.S. Cl. ..... 162/253; 162/258; 162/259; 162/263; 162/DIG. 6

(58) Field of Search ..... 162/198, 252, 162/253, 258, 259, 263, DIG. 6, DIG. 10, DIG. 11

(56) References Cited

FOREIGN PATENT DOCUMENTS 981327 6/1998 (FI) .
981328 6/1998 (FI) .

*Primary Examiner*—Dean T. Nguyen
(74) *Attorney, Agent, or Firm*—Steinberg & Raskin, P.C.

(57) ABSTRACT

Method for regulating the basis weight of paper or board in a paper or board machine in which the machine stock is comprised of a number of component stocks and the basis weight of the dry paper or board is measured, preferably by on-line basis-weight measurement at the end of the machine. Based on the stock target of the machine stock formed on the basis of basis-weight regulation and the predetermined stock proportions of the component stocks, a metering target is determined for each component stock. Then, based on the consistency of a component stock measured from each feed line of a component stock and on a metering target determined for each component stock, a flow target is determined for each component stock. Finally, the flow of each component stock is regulated based on the flow target determined for each component stock.

16 Claims, 5 Drawing Sheets

METHOD FOR REGULATING BASIS WEIGHT OF PAPER OR BOARD IN A PAPER OR BOARD MACHINE

FIELD OF THE INVENTION

The present invention relates to a method for regulating the basis weight of paper or board in a paper or board machine in which the machine stock comprises several component stocks and in which the basis weight of the dry paper or board is measured, preferably by means of on-line basis-weight measurement at the end of the machine.

BACKGROUND OF THE INVENTION

Regarding its principal features, the stock feed at a paper machine is generally as follows. The stock components are stored at the paper mill in separate storage towers. From the storage towers, the stocks are fed into stock chests, and from the stock chests further into a common blend chest, in which the stock components are mixed with each other. From the blend chest, the stock is fed into a machine chest, and from the machine chest there is an overflow back into the blend chest.

From the machine chest, the stock is fed into a dilution part of the wire pit, in which the stock is diluted with white water recovered from the wire section and serving as dilution water. From the wire pit, the stock is fed through centrifugal cleaners into a deaeration tank. From the deaeration tank, stock free from air is fed through a machine screen into the headbox, i.e., into the inlet header thereof, and through the slice opening of the headbox to the wire section. A bypass flow of the headbox is fed back into the deaeration tank, and the white water recovered from the wire section is fed into the wire pit.

The basis weight and the ash content of the paper are measured on-line right before reeling from a ready, dry paper, usually by means of measurement apparatuses based on beta radiation and x-radiation. Based on this measurement, the basis weight of the paper is regulated, for example, by means of a so-called basis weight valve by whose means the stock flow after the machine chest is controlled. A second possibility is regulation of the speed of rotation of the pump that feeds stock from the machine chest into the wire pit. The ash content is controlled by dosing of fillers. The basis weight profile of the paper in the cross direction is obtained when the measurement apparatus is installed to move back and forth across the web.

In prior art arrangements of regulation in a paper machine, the metering of component stocks usually takes place with the aid of the surface level in the blend chest, the consistency of component stock, and a pre-determined stock proportion reference value. The ash contents of component stocks are not used for controlling the metering of component stocks. The measurement values obtained by means of measurement of basis weight are used in the control of the basis weight valve situated after the machine chest, but these values are not used for controlling the metering of component stocks.

In prior art regulation of basis weight, exclusively the overall consistency and the overall flow rate of the stock are controlled. Regulation of basis weight taking place by means of the flow departing from the machine chest is disturbed, among other things, by disturbance in the consistency of the machine stock, which disturbance arises from incomplete mixing of the stock in the blend chest and in the machine chest. The volumes of the blend chest and of the machine chest are considerable, so that the regulation of their surface levels readily starts oscillating, which results in disturbance in the regulation of the basis weight. From the recovery of fibers, ash disturbance arises in the blend chest. The dynamics of the recovery of fibers produce different dynamics and dwell times for a part of the stock. Owing to the large volumes of the machine chest and the blend chest, a long stilling time is required before the basis weight can be set at the desired level. For this reason, a change in the paper grade being produced by the machine is slow.

OBJECTS AND SUMMARY OF THE INVENTION

It is an object of the present invention to provide a new and improved method for regulating the basis weight of a paper or board web in a paper or board machine.

It is another object of the present invention to provide a method for regulating the basis weight of a paper or board web which in a paper or board machine enables a quick change in the grade of paper or board being produced.

In order to achieve these objects and others, a method for regulating basis weight of paper or board in a paper or board machine formed from a machine stock comprised of a plurality of component stocks in accordance with the invention comprises the steps of determining a stock target of the machine stock which is the amount of fibers in the machine stock per unit time and relates to the basis weight of the paper or board, determining a metering target for each component stock based on the stock target, the metering target being the amount of the component stock per unit time flowing to form the machine stock and passing each component stock from a source thereof through a respective feed line. The consistency of each component stock is measured, preferably in a respective one of the feed lines, and a flow target for each component stock is determined based on the measured consistency of the component stock and the metering target determined for the component stock. The flow target is the volume of the component stock per unit time flowing to form the machine stock. The flow of each component stock through the respective feed line is then regulated based on the flow target determined for the component stock.

Further, desired proportions of the component stocks in the paper or board can be determined and the stock target determined based at least in part on the determined proportions of the component stocks. For example, the desired proportions of the component stocks can be determined by determining a fiber length target of the machine stock which is a desired fiber length of the machine stock, measuring data relating to the length of fibers in the component stocks, e.g., in the feed lines, and optimizing the proportions of the component stocks based at least in part on the measured fiber length data and the determined fiber length target of the machine stock. The proportions of the component stocks may be optimized additionally based on the cost of the component stocks and/or the availability of the component stocks. The proportions of the component stocks may be optimized by determining an average value of the fiber length of each component stock from the measured fiber length data, determining a weighted average value of the fiber length of each component stock from the measured fiber length data or forming a distribution of the fiber length of each component stock from the measured fiber length data at specified time intervals.

In additional embodiments, the ash content of each component stock is measured, e.g., in the feed line, and the flow target of each component stock is determined additionally based on the measured ash content of the component stock.

The method in accordance with the present invention for regulation of the basis weight by means of metering of component stocks is particularly well suited for process arrangements in which there is no blend chest/machine chest arrangement that equalizes the pumping and the consistencies. For precise regulation of basis weight, in the method in accordance with the invention the following properties have been discovered:

- the dilution of component stocks to metering consistency takes place before the component-stock stock chest,
- the regulation of the basis weight takes place from the component-stock stock chest by means of regulation of the flows of component stocks, and
- the diluting to the headbox consistency takes place in two stages, of which in the first stage there is a substantially constant flow, and in the second stage the flow is regulated by means of a control signal received from the headbox pressure regulation.

The method in accordance with the invention for regulating the basis weight by means of metering of component stocks can also be used in conventional process arrangements in which a machine chest/blend chest arrangement is applied. In such a case, the basis weight regulation circuit controls, in parallel, both the traditional basis weight valve or the regulations of the flow of machine stock and the regulation of the metering of component stocks in accordance with the invention. To the regulation of component stocks in accordance with the invention, the change in surface level computed by the surface level controller of the blend chest is fed as a correction signal, which change in surface level compensates for any disturbance caused by a flow coming from the recovery of fibers and for calibration errors of measurement apparatus.

The method in accordance with the invention for regulation of the basis weight by means of metering of component stocks permits a considerably simpler process solution, as compared with conventional process solutions. The novel process arrangement permits very quick change of paper grade, and precise metering of the desired quantity of each component stock is possible Moreover, by means of the method in accordance with the invention, more precise control of fiber length, more precise control of ashes, uniform mixing, and easier measurement operations are achieved. Also, regulation of the flows and consistencies of the component stocks can be made precise more readily, because there are fewer regulations of flow and consistency that interfere with each other.

With respect to a novel process arrangement related to the method in accordance with the present invention, reference is made to the current assignee's Finnish Patent Application No. 981327.

With respect to metering of component stocks applicable in the novel process arrangement related to the method in accordance with the present invention, reference is made to the current assignee's Finnish Patent Application No. 981328.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
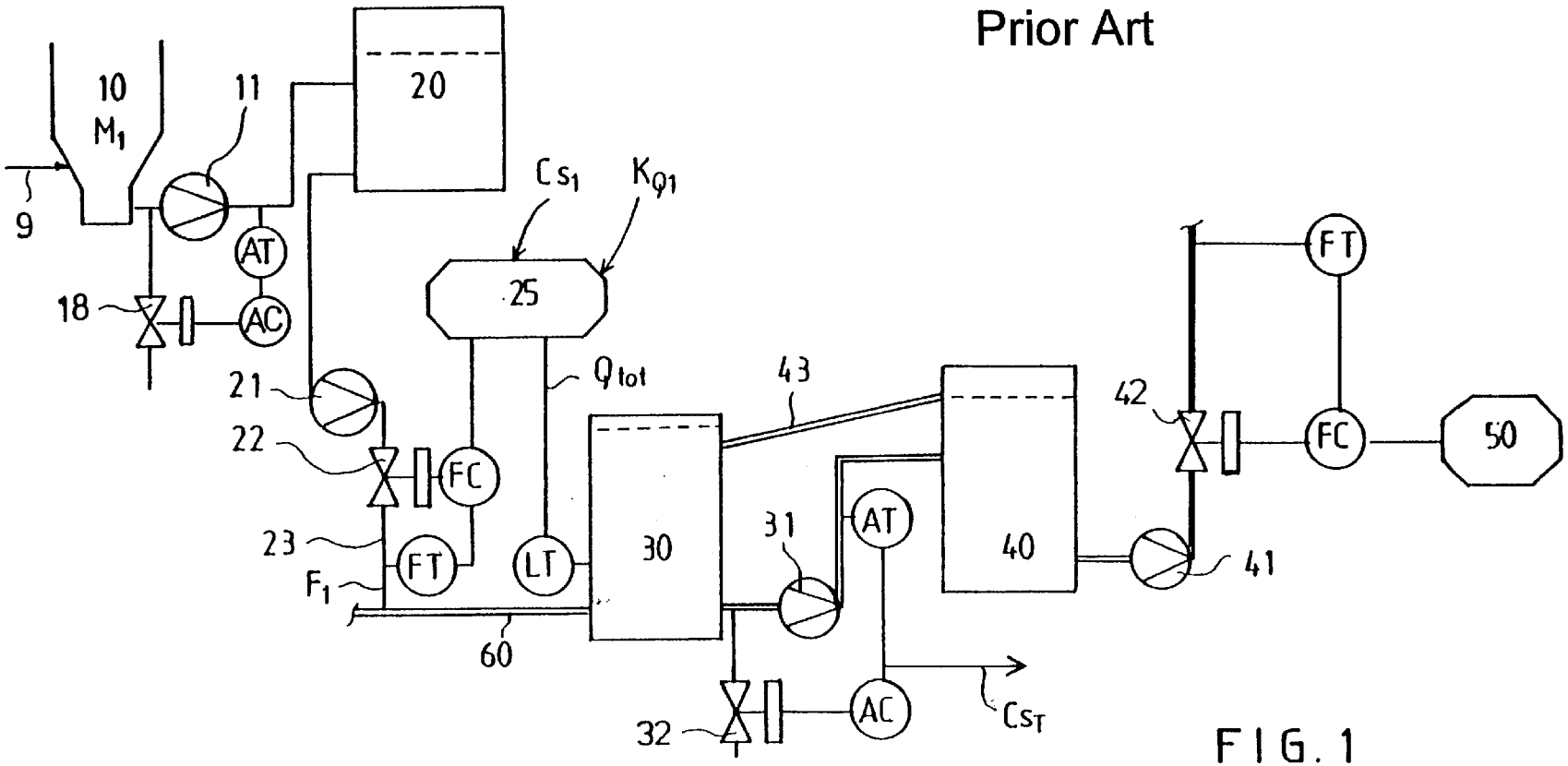
FIG. 1 is a schematic illustration of a prior art process arrangement of the stock feed in a paper machine.

Referring to FIGS. 1–5 wherein like reference numerals refer to the same or similar elements, FIG. 1 is a schematic illustration of a conventional prior art process arrangement of the stock feed in a paper machine. Only one component stock is shown in FIG. 1 and the recovery of fibers, the regulation of the flow of the component stock, or the regulation of the surface level in the stock chest of the component stock have not been illustrated.

In FIG. 1, a component stock $M_1$ is fed from a storage tower 10 by means of a first pump 11 into a stock chest 20. A dilution water flow is passed through a regulation valve 18 to mix with the component stock before a first pump 11. Further, the component stock is diluted in the bottom portion of the storage tower 10 by means of a dilution water flow 9 passed to the bottom portion. From the stock chest 20, the component stock $M_1$ is directed by means of a second pump 21 through a regulation valve 22 and through a feed pipe 23 to a main line 60 of the process, which passes into a blend chest 30. From the blend chest 30, the stock is directed by means of a third pump 31 into a machine chest 40. From the machine chest 40, the machine stock $M_T$ is fed by means of a fourth pump 41, through a second regulation valve 42, into the short circulation. Moreover, from the machine chest 40, there is an overflow 43 passing back to the blend chest 30. The blend chest 30 and the machine chest 40 form a stock equalizing unit, and in them the stock is diluted to the ultimate metering consistency. Further, by their means, uniform metering of the machine stock is enabled.

The metering of the component stocks $M_i$ into the blend chest 30 takes place so that attempts are made constantly to keep a substantially constant surface level in the blend chest 30. Based on changes in the surface level in the blend chest 30, which changes are measured by a surface level detector LT, the surface level controller computes the total requirement $Q_{tot}$ of stock to be metered, which information is fed to the component stock metering-control block 25. Also, a pre-determined stock proportion value $K_{Qi}$ of the component stock $M_i$ and a consistency value $Cs_i$ of the component stock $M_i$ are fed to the metering-control block 25.

Based on the total requirement $Q_{tot}$ of stock $M_T$ and the pre-determined proportions $K_{Qi}$ of component stocks, the metering-control block 25 computes the requirement $Q_i$ of feed of component stock. Based on the component stock feed requirement $Q_i$ and on the data $Cs_i$ on the consistency of the component stock $M_i$, the component stock metering-control block 25 computes the flow target $F_i$ of the component stock $M_i$. Based on this flow target $F_i$, the regulation valve 22 is controlled so as to produce the flow $F_i$ into the blend chest 30. The flow $F_i$ of the component stock $M_i$ is also measured constantly by means of a flow detector FT, whose measurement signal is fed through the flow controller FC to the component stock control valve 22.

From the blend chest 30, the stock is fed at a substantially constant flow velocity by means of the third pump 31 into the machine chest 40. At this pumping stage, the consistency of the stock is also regulated to the desired target consistency of the machine chest. This is accomplished by means of dilution water, which is fed through the regulation valve 32 to the outlet of the blend chest 30 to the suction side of the third pump 31. By means of the dilution water, the stock present in the blend chest 30, which is typically at a consistency of about 3.2%, is diluted to the ultimate metering consistency of about 3%. To the dilution water regulation valve 32, the metering signal of a consistency detector AT is directed, which detector AT is connected to the pressure side of the pump 31. The measurement signal $Cs_T$ of the consistency detector AT, measured either after the third pump 31 or after the fourth pump 41, is passed to a basis weight controller 50.

The regulation of the basis weight takes place so that the basis weight controller 50 controls the regulation valve 42 placed after the fourth pump 41. By means of this regulation valve 42, the flow of the stock to be fed into the short circulation is regulated, which flow affects the basis weight of the paper web obtained from the paper machine. When the flow is increased, the basis weight becomes higher, and when the flow is reduced, the basis weight becomes lower.

In the basis weight controller 50, changes in the machine speed, and possibly also changes in the consistency of the machine stock, changes in metering of ashes, and changes in retention are taken into account. Based on these parameters, the basis weight regulation computes a target value for the flow of machine stock.

In prior art arrangements, generally it is assumed that, from the area of the short circulation, no disturbance comes that affects the basis weight of the paper web. In this connection, it is also assumed that, in the operation of the centrifugal cleaners, the deaeration tank, and of the machine screen, no such changes occur as a result of which stock components of the machine stock would depart from the process. Likewise, it is assumed that the consistency of the dilution water pumped from the wire pit remains substantially constant.

Figure 2:
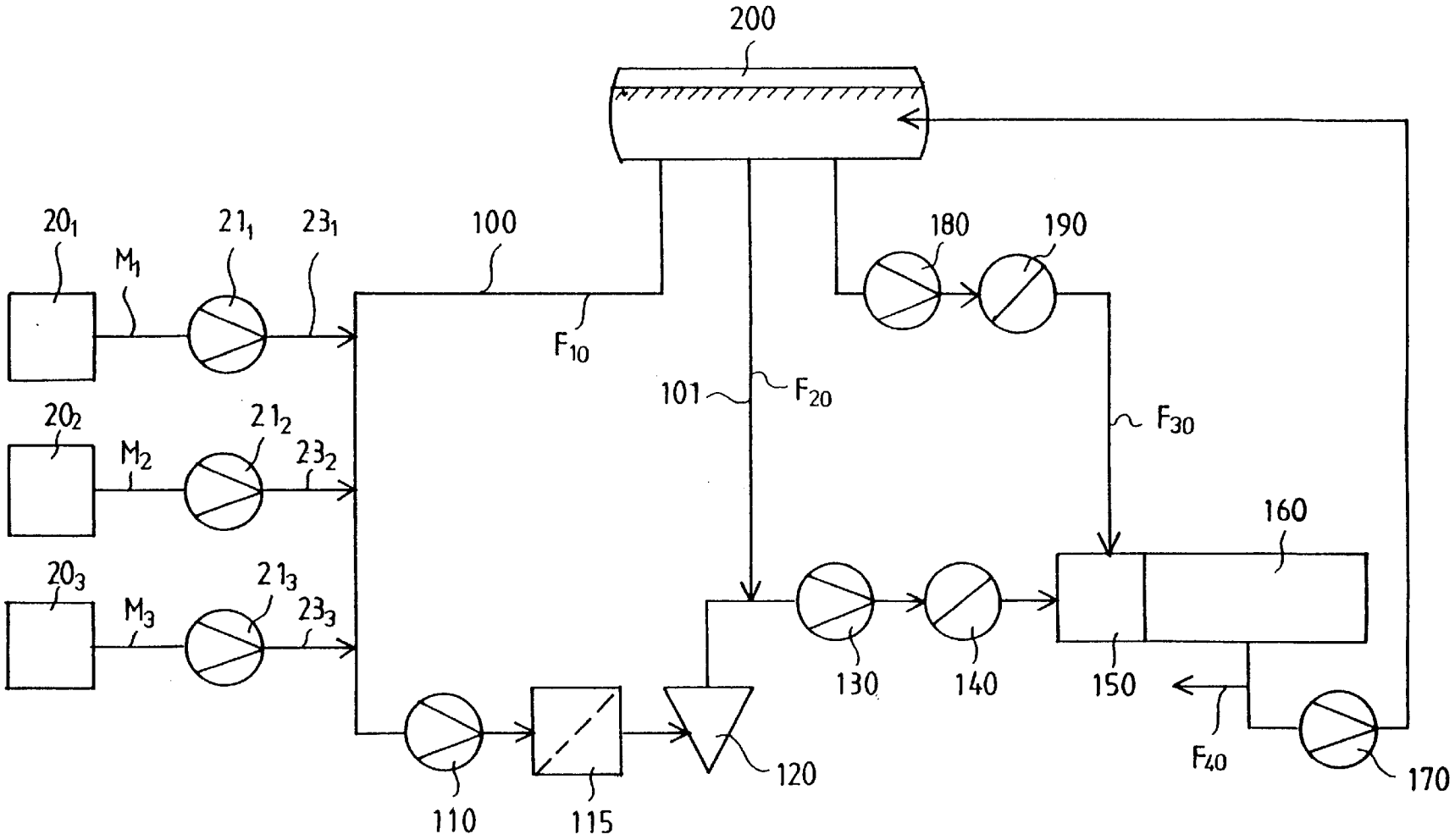
FIG. 2 is a schematic illustration of a stock feed arrangement in which the method in accordance with the present invention for regulating the basis weight of paper by means of metering of component stocks can be applied.

FIG. 2 is a schematic illustration of a stock feed arrangement in which the regulation of the basis weight of the paper by means of metering of component stocks in accordance with the present invention can be applied.

In FIG. 2, each component stock $M_i$ is fed from a respective stock chest $\mathbf{20}_i$ by means of a pump $\mathbf{21}_i$ through a component stock feed pipe $\mathbf{23}_i$ into a feed line 100 between the deaeration tank 200 and a first pump 110 in the main line of the process. The first pump 110 in the main line directs or feeds the stock through a screen 115 and through a centrifugal cleaner 120 to the suction side of the second pump 130 in the main line. The second pump 130 in the main line feeds the stock through the machine screen 140 into the headbox 150. The white water recovered from the wire section 160 is fed by means of a circulation water pump 170 into the deaeration tank 200. Any excess white water is passed by means of an overflow $F_{40}$ to atmospheric pressure.

In the deaeration tank 200, there could be an air space subjected to a vacuum above the free surface of the stock to thereby cause the removal of air from the white water. Also, in the screen 115, for example, shivers and debris can be removed from the stock, and in a centrifugal cleaner 120, for example, sand and other particles heavier than fibers can be removed from the stock.

The component stocks $M_i$ are metered from component stock chests $\mathbf{20}_i$ precisely to the mixing volume of the stocks in the dilution water feed pipe 100 coming from the deaeration tank 200. The dilution water feed pipe 100 defines a closed space in which the component stocks $M_i$ are mixed and diluted with the flow of dilution water from the deaeration tank 200 (the deaerated white water constituting the dilution water in this case). The precise, substantially constant pressure of the component stock to be metered is produced so that the surface level and the consistency in the component stock chest $\mathbf{20}_i$ are kept substantially constant and so that a substantially constant back pressure is arranged at the mixing point of the component stocks $M_i$. A precise, constant pressure of the mixing volume is produced so that a sufficient reduction in pressure occurs between the nozzle of the component stock $M_1$ and the mixing volume, in which case, changes of pressure in the mixing volume do not interfere with the metering. The mixing volume is composed of the dilution water feed pipe 100 passing to the first feed pump 110, the feed pipes $\mathbf{23}_i$ of the metering pumps $\mathbf{21}_i$ and connection arrangements between them.

The diluting of the stock is carried out in two stages. The dilution of the first stage is carried out at the suction side of the first pump 110 in the main line when the component stocks $M_i$ are fed into the feed line 100 between the deaeration tank 200 and the first pump 110 in the main line. In the deaeration tank 200, the surface level is kept substantially constant by means of a surface level controller of the primary side (not shown in FIG. 2), which controls the speed of rotation of the circulation water pump 170. The flow into the feed line 100 takes place with a ram pressure at a constant pressure, in which case, the feed pressure of the dilution water flow $F_{10}$ remains constant. This secures a substantially constant back pressure for the component stocks $M_i$ when they are fed into the feed line 100. By means of the first pump 110 in the main line, a substantially constant volume is pumped constantly to stock cleaning 115, 120 and to the dilution of the second stage.

The dilution in the second stage is carried out at the suction side of the second feed pump 130 in the main line, to which suction side a second dilution water flow $F_{20}$ of substantially invariable pressure is passed with a ram pressure from the deaeration tank 200. The regulation of the pressure in the headbox 150 controls the speed of rotation of the second feed pump 130 in the main line.

Further, a third dilution water flow $F_{30}$ is led from the deaeration tank 200 to the dilution headbox 150 by means of a dilution water feed pump 180 through a screen 190. By means of this third dilution water flow $F_{30}$ passed into the dilution headbox 150, the stock consistency is profiled in the cross direction of the paper machine.

Figure 3:
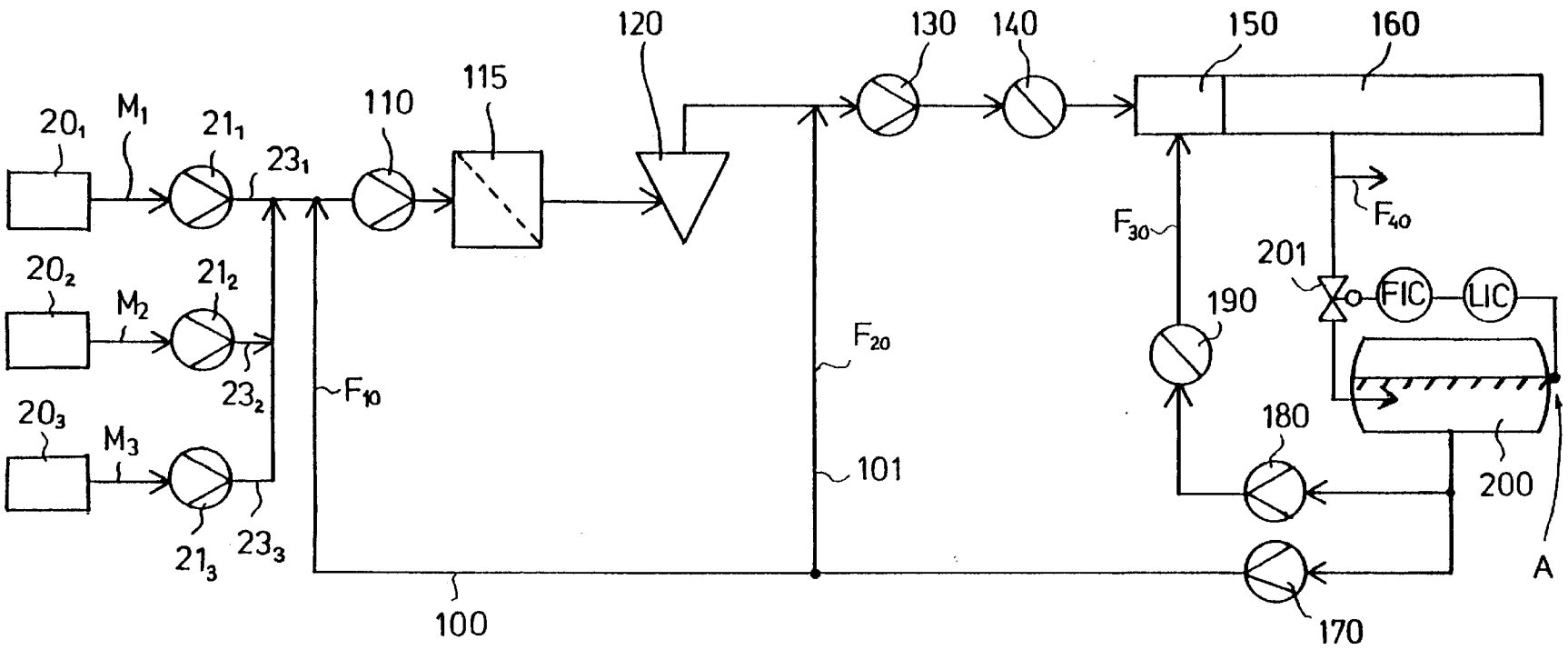
FIG. 3 shows a modification of the process arrangement shown in FIG. 2, in which the method in accordance with the invention can also be applied.

FIG. 3 illustrates a modification of the process arrangement shown in FIG. 2, in which modification the deaeration tank 200 is situated below the wire section 160. In such a case, the white water can be passed from the wire section 160 directly by means of ram pressure into the deaeration tank 200. From the deaeration tank 200, the dilution water (white water from which air is removed) is fed by means of the circulation water pump 170 into the first $F_{10}$ and second $F_{20}$ dilution stages in the main line of the process. Further, into the dilution headbox 150, a third dilution water flow $F_{30}$ is optionally fed by means of a dilution water feed pump 180 through a screen 190. In the first $F_{10}$ and second $F_{20}$ dilution water flows, a substantially constant pressure can be maintained by means of regulation of the speed of rotation of the circulation water pump 170 and/or by means of throttles in the feed lines 100, 101. Also in this case, there is an overflow $F_{40}$ between the wire section 160 and the deaeration tank 200, from which overflow any excess white water is passed to atmospheric pressure. From the deaeration tank 200, the surface level is measured at the point A, and by means of the surface level controller LIC, the flow controller FIC is controlled, which controls a valve 201 provided in the line passing from the wire section 160 to the deaeration tank 200. In this manner, the surface level in the deaeration tank 200 is kept at a substantially constant level.

Figure 4:
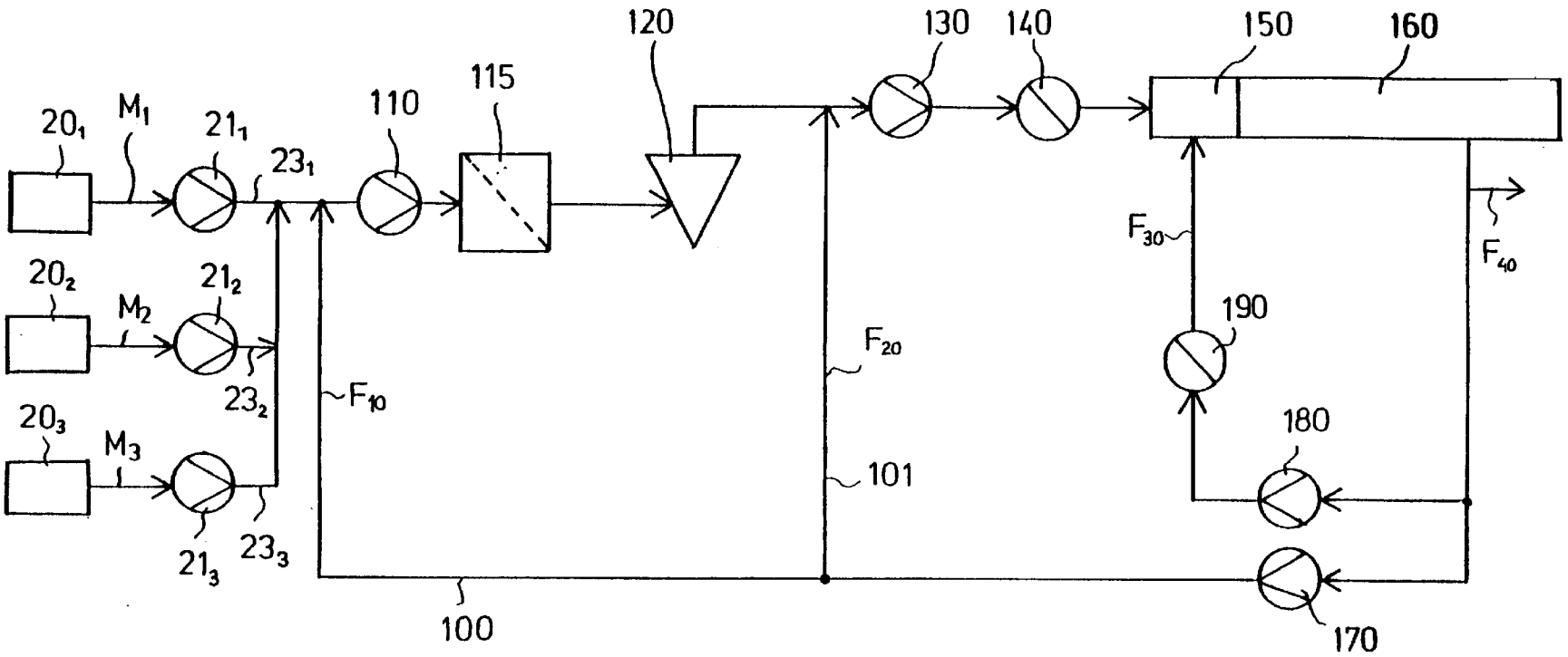
FIG. 4 shows a second modification of the process arrangement shown in FIG. 2, in which the method in accordance with the invention can also be applied.

FIG. 4 shows a second modification of the process arrangement shown in FIG. 2, in which modification, the deaeration tank 200 has been removed completely. In such a case, the headbox 150 and the wire section 160 must be closed so that the stock does not come into contact with the surrounding air. The white water collected from the closed wire section 160 is then fed directly, by means of the circulation water pump 170, into the first $F_{10}$ and second $F_{20}$ dilution stages in the main line of the process.

The method in accordance with the invention can, of course, also be applied in connection with the process arrangements illustrated in FIGS. 3 and 4.

In FIG. 2, the feed pipes $\mathbf{23}_i$ of the component stocks $M_i$ have been passed directly to the dilution water feed pipe 100. In FIGS. 3 and 4, the component stock feed pipes $\mathbf{23}_i$ have been passed first into a common pipe, which common pipe has then been passed to the dilution water feed pipe 100. From the point of view of the present invention, the coupling between the component stock $M_i$ feed pipes $\mathbf{23}_i$ and the first dilution water feed pipe 100 can be of any kind whatsoever, provided that the mixing together of the component stocks and the mixing of the component stocks with the dilution water can be made efficient.

In FIGS. 2–4, bypass flow of stock or dilution water at the inlet header of the headbox 150 have not been illustrated. These bypass flows may be arranged here by means of short feed-back connections.

FIGS. 2–4 illustrate arrangements in which a dilution headbox is employed, but the invention can also be applied in connection with a headbox of a different sort. In such a case, a second circulation water pump 180 and a related screen 190 are not needed at all.

The main line screen 115 and the centrifugal cleaner 120 in the embodiments shown in FIGS. 2–4 can comprise one or more stages.

The first feed pump 110, the screen 115, and the centrifugal cleaner 120 in the main line in the embodiments shown in FIGS. 2–4 can be omitted completely in a situation in which the component stocks $M_i$ have already been cleaned to a sufficiently high level of purity before the stock chests $\mathbf{20}_i$. In such a case, in the main line of the process, just the feed pump 130 and the following machine screen 140 are needed.

Figure 5:
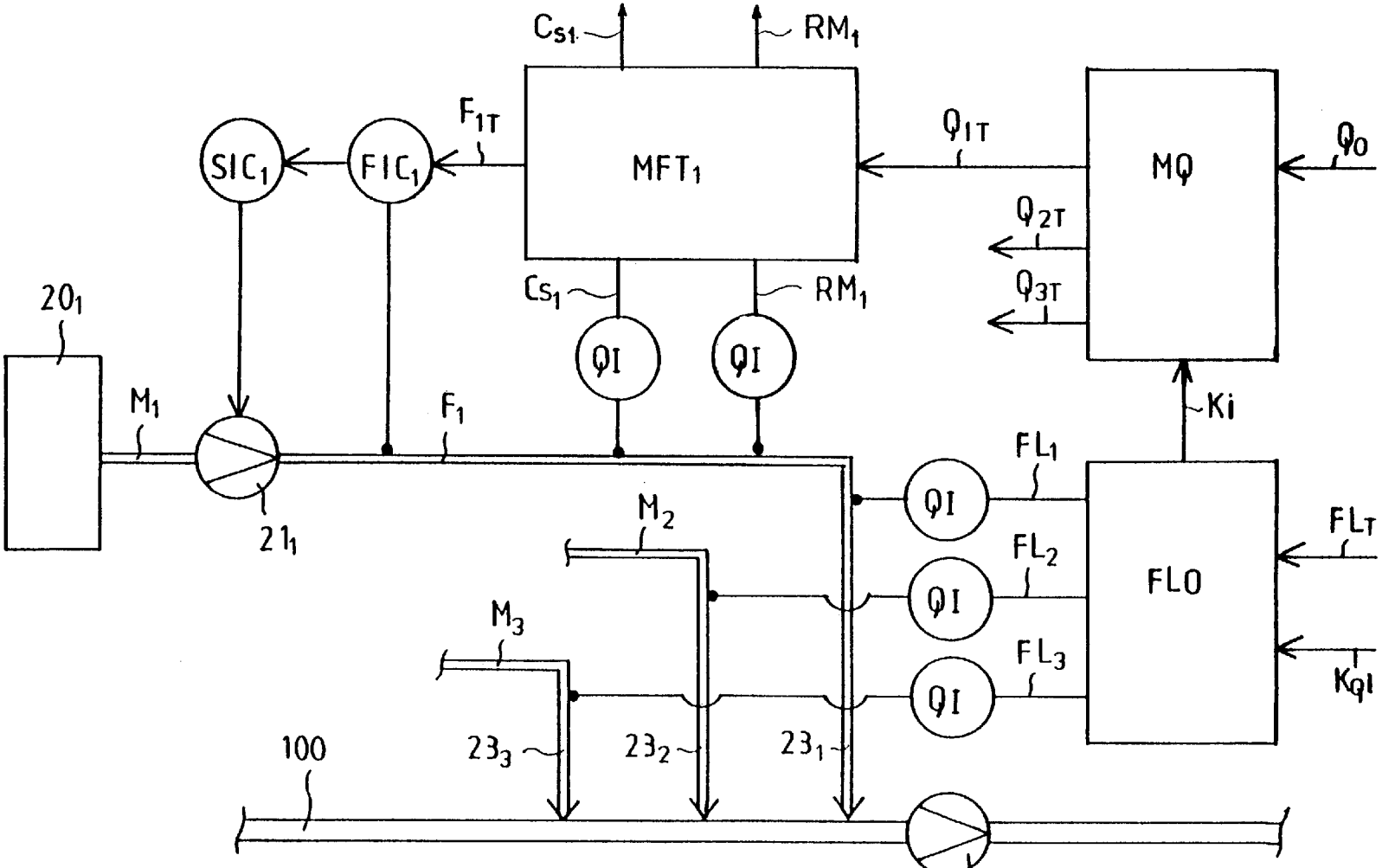
FIG. 5 is a schematic illustration of the regulation of the basis weight of paper by means of metering of component stocks in accordance with the present invention.

FIG. 5 is a schematic illustration of regulation of the basis weight of paper by means of metering of component stocks $M_i$ in accordance with the invention. Where applicable, the reference notations in FIG. 5 correspond to those used in FIGS. 2, 3 and 4. FIG. 5 illustrates the feed of a component stock $M_1$ as a flow $F_1$ by means of a component stock feed pump $\mathbf{21}_1$ into the feed line 100 between the deaeration tank (FIGS. 2 and 3) and the first feed pump 110 in the main line of the process. Of the other component stocks $M_2$, $M_3$, only the connections to the feed line 100 are shown. The invention is not confined to three component stocks $M_1$, $M_2$, $M_3$ of which the stock $M_T$ is formed, but the number of component stocks $M_i$ can be Z, wherein Z is a positive integer number $\geqq 2$.

It is the starting point of the metering of the component stocks in accordance with the present invention that the volume and the consistency of each component stock $M_i$ are kept constantly constant in the stock chest $\mathbf{20}_i$. In this respect, reference is made to the current assignee's Finnish Patent Application No. 981328, in which application a possibility is described for keeping the surface level and the consistency of a component stock $M_i$ in a stock chest $\mathbf{20}_i$ at a constant level.

In the first stage in the regulation process related to the metering of component stocks $M_i$, the stock proportions $K_i$ of the component stocks $M_i$ are optimized on the basis of fiber lengths $FL_i$ in a fiber length optimizing block FLO. A predetermined target value $FL_T$ of fiber length of the machine stock $M_T$ and a pre-determined stock proportion reference $K_{Qi}$ of one or more component stocks $M_i$ are fed into the fiber length optimizing block FLO. Further, the fiber lengths $FL_i$ of component stocks measured from the component stock feed lines $\mathbf{23}_i$ are fed into the fiber length optimizing block FLO. Measurement of the fiber lengths of the component stocks is not limited to measurement in the component stock feed lines.

The target value $FL_T$ of fiber length of the machine stock $M_T$ can be given as one discrete numerical value, or it can be given as the desired distribution of the fiber length in the machine stock $M_T$. In both cases, of course, the fiber length target $FL_T$ of the machine stock $M_T$ must be such that it can be carried into effect in general with the distributions of fiber lengths in the available component stocks $M_i$.

If the target value $FL_T$ of the fiber length of the machine stock $M_T$ has been given as one discrete numerical value, the average value of the fiber length $FL_i$ in the component stock $M_i$ concerned can be calculated from the individual fiber length values $FL_{ij}$ obtained from measurement of fiber length of the component stock. From a specimen material comprising, e.g., 10,000 individual fiber length measurements $X_m$, the sample average can be calculated as an arithmetic average from the equation:

$$\overline{x_i} = \frac{1}{N}\sum_{m=1}^{N} x_m$$

wherein N is the number of specimens $X_m$.

The specimen material can also be first classified into classes, e.g., into 144 fiber length classes, after which, from the classified specimen material, the sample average of fiber length of the component stock can be calculated from the equation:

$$\overline{y_i} = \frac{1}{N}\sum_{m=1}^{k} f_m * y_m$$

wherein $y_1, \ldots, y_k$ are mean points of the class gaps, and $f_1, \ldots, f_k$ are corresponding class frequencies.

Out of the classified specimen material, the weighted sample average of the fiber length of the component stock can also be calculated from the following equation:

$$\overline{y_{ip}} = \frac{\sum_{m=1}^{k} f_m * y_m^2}{\sum_{m=1}^{k} f_m * y_m}$$

This arithmetic average, sample average, or weighted sample average determined for each fiber length of a component stock is then used for optimizing the fiber length.

If the target value $FL_T$ of the fiber length in the machine stock $M_T$ has been given as a distribution, for example, out of the mean points $Y_m$ of the classified specimen material and out of the class frequencies $f_m$, a distribution of the fiber lengths $LF_i$ in the component stocks $M_i$ is formed, which distribution is then used for optimizing the fiber length.

Based on the fiber lengths $FL_i$ in the component stocks $M_i$ and on the fiber length target $FL_T$ of the stock $M_T$, it is possible to determine an optimal proportion $K_i$ of each stock $M_i$ in the stock $M_T$. With this data, it is possible to form two basic equations:

$$\Sigma K_i * FL_i = FL_T$$

$$\Sigma K_i = 1$$

Thus, the fiber lengths $FL_i$ in the component stocks $M_i$ and the fiber length $FL_T$ in the machine stock $M_T$ can be discrete numbers or distributions of fiber length. If a distribution of fiber length is concerned, an arithmetic summing is, of course, not possible, but in such a case, the fitting is carried out on the basis of areas.

In the case of three component stocks $M_1$, $M_2$, $M_3$ illustrated in FIG. 5, we have two equations and three unknown quantities $K_1$, $K_2$, $K_3$, so that a third equation is needed further in order that the unknown quantities could be solved. This third equation can be formed, e.g., on the basis of the prices of the component stocks $M_i$ so that more expensive component stocks $M_i$ are used to a lower extent, and less expensive component stocks $M_i$ are used to a higher extent. The third equation can also be based on availability of the component stocks $M_i$ so that component stocks $M_i$ that are less readily available are used lo a lower extent, and more readily available component stocks $M_i$ are used to a higher extent. The third equation can also be based on the idea that a certain amount of broke must be used, etc. Combined optimizing of cost and availability can also be concerned, etc.

In order that the proportions of component stocks $M_i$ could be solved in a closed form, the number of equations needed is always equal to the number of unknown quantities.

In addition to the limitations mentioned above, each component stock $M_i$ also has a pre-determined minimal value $K_{imin}$ of stock proportion $K_i$, below which the regulation circuit cannot proceed, and a maximal value $K_{imax}$, which the regulation circuit cannot surpass.

In cases in which the optimizing in respect of cost or of other parameters cannot be solved for some reason or other, a pre-determined. stock proportion $K_{Qi}$ of one or several component stocks $M_i$ is employed.

The stock proportion target $K_i$ of each component stock $M_i$ determined in the fiber length optimizing block FLO is, after this, fed into the component stock computing block MQ.

The stock target $Q_0$ of the stock $M_T$ is also fed into the component stock computing block MQ, which target has been formed at the end of the machine from dry paper based on basis weight measurement. The stock target $Q_0$ determines the amount of fibers desired for the stock $M_T$ per unit of time, e.g. kilograms per second (kg/s). When the stock target $Q_0$ of the stock $M_T$ and the stock proportion $K_i$ of each component stock are known, the metering target $Q_{iT}$ (kg/s) of each component stock can be calculated from the equation:

$$Q_{iT} = K_i * Q_0.$$

After this, the metering target $Q_{iT}$ of each component stock $M_i$ is fed to the computing block $MFT_i$ of the component stock concerned. FIG. 5 shows the computing block $MFT_1$ of the flow target of one component stock $M_1$ only.

Further, the consistency $Cs_i$ and the ash content $RM_i$ of the component stock $M_i$ concerned, measured from the feed line $\mathbf{23}_i$ after the feed pump $\mathbf{21}_i$, are fed to the computing block $MFT_i$ of the flow target of the component stock $M_i$. In the computing block $MFT_i$ of the flow target of the component stock $M_i$, it is now possible to compute the flow target $F_{iT}$ of the component stock $M_i$. First, the fiber proportion $Cs_{iFiber}$ of the component stock $M_i$ is determined from the equation:

$$Cs_{iFiber} = Cs_i * (100 - RM_i)/100$$

and after this the flow target $F_{iT}$ of the component stock $M_i$ (l/s=liters per second) is determined from the equation:

$$F_{iT} = R_i * Q_{iT} * 100/Cs_{Fiber}.$$

$R_i$ is a correction coefficient, by whose means any calibration errors and similar scaling errors are corrected.

The flow target $F_{iT}$ of the component stock $M_i$ is fed to the flow controller $FIC_i$, which again controls the rev. (revolution)controller $SIC_i$ of the feed pump $\mathbf{21}_i$ of the component stock $M_i$. The regulation of flow can be accomplished in the way described above, by directly regulating the speed of rotation of the feed pump $\mathbf{21}_i$ of the component stock $M_i$, or by means of a regulation valve (not shown in FIG. 5) placed after the feed pump $\mathbf{21}_i$, or by means of a combination of these modes. In a pure regulation valve control, the speed of rotation of the feed pump $\mathbf{21}_i$ of the component stock $M_i$ is kept substantially constant, and the regulation of flow takes place exclusively by means of the regulation valve by throttling the flow. In combination regulation, both the speed of rotation of the feed pump $\mathbf{21}_i$ of the component stock $M_i$ and the throttle of the regulation valve are regulated.

The ash content $RM_i$ and the consistency $Cs_i$ measured from the component stock $M_i$ are also fed into the control circuit of the machine.

In the embodiment of the method in accordance with the invention described above, the stock proportions $K_i$ of the component stocks $M_i$ are optimized on the basis of the fiber lengths $FL_i$ measured from the component stocks $M_i$. Further, from each feed line $\mathbf{23}_i$ of a component stock $M_i$, both the consistency $Cs_i$ of the component stock concerned and the ash content $RM_i$ of the component stock concerned are measured. By means of this arrangement, the essential parameters related to the stock and affecting the quality of the paper are controlled.

In the method in accordance with the invention, it is not necessary to measure the fiber lengths $Fl_i$ from the component stocks $M_i$, but the metering targets $Q_{iT}$ of the component stocks $M_i$ can be computed on the basis of the stock proportion target $Q_0$ of the basis weight controller and on the basis of pre-determined stock proportions $K_i$ of component stocks $M_i$. In such a case, of course, some of the precision of the regulation of the component stocks is lost. Also, in such a case, the fiber lengths of the component stocks are not controlled, which may result in disturbance in the quality of the paper.

Moreover, it is not necessary in the method in accordance with the present invention to measure the ash content $Cs_i$ of each component stock $M_i$, but rather, from each feed line $\mathbf{23}_i$ of component stock $M_i$, it is possible to measure the consistency $Cs_i$ of the component stock $M_i$ concerned only. In such a case, in the stock target $Q_0$ of the stock $M_T$ received from the basis weight controller, the ash content of the stock $M_T$ has already been taken into account, in which case, the flow target $F_{iT}$ of each component stock $M_i$ can be computed directly on the basis of the metering target $Q_{iT}$ and of the measured consistency $Cs_i$ of the component stock. Also in this alternative embodiment, some of the precision of regulation is lost. In such a case, the ash contents of the component stocks are not controlled, which may result in disturbance in the quality of the paper.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

I claim:

1. A method for regulating basis weight of paper or board in a paper or board machine formed from a machine stock ($M_T$) comprised of a plurality of component stocks ($M_i$), the method comprising the steps of:

measuring a basis weight of the dry paper or board at the end of the paper machine;

determining a stock target ($Q_0$) of the machine stock ($M_T$) based on the measured basis weight of the paper or board, determining desired stock proportions ($K_{Qi}$) of the component stocks ($M_i$) in the paper or board, determining a metering target ($Q_{iT}$) for each of the component stocks ($M_i$) based on the stock target ($Q_0$) and the stock proportions ($K_{Qi}$), the metering target being the amount of the component stock per unit time flowing to form the machine stock, passing each of the component stocks ($M_i$) from a respective stock chest ($\mathbf{20}_i$) through a respective feed line ($\mathbf{23}_i$) to a mixing volume, measuring consistency ($Cs_i$) of each of the component stocks ($M_i$) in a respective one of the feed lines ($\mathbf{23}_i$) , determining a flow target ($F_{iT}$) for each of the component stocks ($M_i$) based on the measured consistency ($Cs_i$) of the component stock and the metering target ($Q_{iT}$) determined for the component stock, the flow target ($F_{iT}$) being the volume of the component stock per unit time flowing to form the machine stock, and selectively regulating the flow of each of the component stocks ($M_i$) that is being fed to the mixing volume based on the flow target ($F_{iT}$) determined for the component stock and thus regulating the flow of machine stock that is being fed to the headbox (150) from the mixing volume to thereby regulate the basis weight of the paper or board.

2. The method of claim 1, wherein the step of determining the desired proportions of the component stocks comprises the steps of:

determining a fiber length target of the machine stock which is a desired fiber length of the machine stock, measuring data relating to the length of fibers in the component stocks, and optimizing the proportions of the component stocks based at least in part on the measured fiber length data and the determined fiber length target of the machine stock.

3. The method of claim 2, wherein the data relating to the length of fibers in the component stocks is measured as the component stocks pass through the feed lines.

4. The method of claim 3, wherein the proportions of the component stocks are optimized based additionally on at least one of the cost of the component stocks and the availability of the component stocks.

5. The method of claim 3, wherein the step of optimizing the proportions of the component stocks comprises the step of determining an average value of the fiber length of each of the component stocks from the measured fiber length data.

6. The method of claim 3, wherein the step of optimizing the proportions of the component stocks comprises the step of determining a weighted average value of the fiber length of each of the component stocks from the measured fiber length data.

7. The method of claim 3, wherein the step of optimizing the proportions of the component stocks comprises the step of forming a distribution of the fiber length of each of the component stocks from the measured fiber length data at specified time intervals.

8. The method of claim 2, wherein the proportions of the component stocks are optimized based additionally on at least one of the cost of the component stocks and the availability of the component stocks.

9. The method of claim 2, wherein the step of optimizing the proportions of the component stocks comprises the step of determining an average value of the fiber length of each of the component stocks from the measured fiber length data.

10. The method of claim 2, wherein the step of optimizing the proportions of the component stocks comprises the step of determining a weighted average value of the fiber length of each of the component stocks from the measured fiber length data.

11. The method of claim 2, wherein the step of optimizing the proportions of the component stocks comprises the step of forming a distribution of the fiber length of each of the component stocks from the measured fiber length, data at specified time intervals.

12. The method of claim 1, further comprising the step of:

measuring ash content of each of the component stocks, the flow target of each of the component stocks being determined additionally based on the measured ash content of the component stock.

13. The method of claim 12, wherein the ash content of the component stocks is measured as the component stocks pass through the feed lines.

14. The method of claim 1, wherein the basis weight of the dry paper or board is measured by means of on-line basis-weight measurement at the end of the machine.

15. The method of claim 1, wherein the source of the component stocks is a plurality of stock chests, each receiving one of the component stocks.

16. The method of claim 1, wherein the step of regulating the flow of each of the component stocks comprises the steps of:

arranging a feed pump in connection with each of the feed lines, and controlling the speed of rotation of the feed pumps to thereby vary the flow of the component stocks through the feed lines.

* * * * *